US007541748B2

(12) United States Patent
Haruna et al.

(10) Patent No.: US 7,541,748 B2
(45) Date of Patent: Jun. 2, 2009

(54) DISCHARGE LAMP LIGHTING DEVICE

(75) Inventors: Fumio Haruna, Yokohama (JP); Masaru Shimizu, Kamakura (JP); Kouji Kitou, Hiratsuka (JP); Tetsunosuke Nakamura, Yokohama (JP)

(73) Assignees: Hitachi, Ltd., Tokyo (JP); Hitachi Media Electronics Co., Ltd., Mizusawa (JP)

( * ) Notice: Subject to any disclaimer, the term of this patent is extended or adjusted under 35 U.S.C. 154(b) by 424 days.

(21) Appl. No.: 11/248,785

(22) Filed: Oct. 11, 2005

(65) Prior Publication Data

US 2006/0028153 A1 Feb. 9, 2006

Related U.S. Application Data

(63) Continuation of application No. 10/888,241, filed on Jul. 8, 2004, now Pat. No. 6,995,523.

(30) Foreign Application Priority Data

Feb. 26, 2004 (JP) ..... 2004-050740

(51) Int. Cl.
*H05B 37/02* (2006.01)

(52) U.S. Cl. ..... 315/291; 315/300; 315/302; 315/307

(58) Field of Classification Search ..... None
See application file for complete search history.

(56) References Cited

U.S. PATENT DOCUMENTS

| | | | | |
|---|---|---|---|---|
| 6,337,906 | B1 | 1/2002 | Bugash et al. | |
| 2002/0191417 | A1 | 12/2002 | Suzuki et al. | |
| 2003/0112015 | A1 | 6/2003 | Takakamo et al. | |
| 2004/0220759 | A1 | 11/2004 | Takakamo et al. | |
| 2005/0067979 | A1 | 3/2005 | Haruna et al. | |
| 2005/0093488 | A1 * | 5/2005 | Hung et al. | 315/307 |
| 2005/0179404 | A1 * | 8/2005 | Veskovic et al. | 315/291 |

FOREIGN PATENT DOCUMENTS

| | | |
|---|---|---|
| JP | 08-008076 | 1/1996 |
| JP | 2002-110379 | 4/2002 |

* cited by examiner

*Primary Examiner*—Trinh V Dinh
(74) *Attorney, Agent, or Firm*—Townsend and Townsend and Crew LLP

(57) ABSTRACT

Disclosed herein is a discharge lamp lighting device which realizes the minute control of the lighting sequence and electric power of a high-pressure discharge lamp and the control of various anti-error protecting functions by mounting a microcomputer. However, since microcomputer processing typically progresses in accordance with the programs previously recorded on a ROM, various actions of the discharge lamp are controlled in accordance with ROM-recorded data settings. To modify these settings, the contents of the ROM need to be updated. Therefore, a function for communicating with an external device is assigned to the microcomputer so that various data settings can be modified.

3 Claims, 8 Drawing Sheets

| | OPERATION MODE | LAMP ON | LOW-POWER MODE |
|---|---|---|---|
| 1 | OFF | L | H |
| 2 | STATIONARY POWER | H | H |
| 3 | LOW POWER | H | L |
| 4 | EXTREMELY LOW POWER | L | L |

EEPROM MEMORY MAP

EEPROM DATA WRITING COMMAND (1-BYTE)

EEPROM DATA READING COMMAND (1-BYTE)

EEPROM DATA WRITING COMMAND (MULTIPLE-BYTE)

EEPROM DATA READING COMMAND (MULTIPLE-BYTE)

DISCHARGE LAMP LIGHTING DEVICE

CROSS-REFERENCES TO RELATED APPLICATIONS

The present application is a continuation of U.S. application Ser. No. 10/888,241 filed Jul. 8, 2004 now U.S. Pat. No. 6,995,523 which claims priority from Japanese application serial no. P2004-050740, filed on Feb. 26, 2004, the contents of which are hereby incorporated by reference in their entirety for all purposes.

BACKGROUND OF THE INVENTION

The present invention relates to a discharge lamp lighting device for a projection-type display apparatus such as a liquid-crystal projector.

Metal-halide lamps, high-pressure mercury lamps, or other high-pressure discharge lamps are used as light sources for projection-type display apparatus such as a liquid-crystal projector, because they have high conversion efficiency and are easily available as light sources close to a point light source in terms of characteristics.

Special discharge lamp lighting devices for supplying the voltage and electric current required are used to light up high-pressure discharge lamps.

Additionally, as disclosed in Japanese Patent Application Laid-Open No. Hei 8-8076 and 2002-110379, schemes in which a microcomputer is used to control a discharge lamp lighting device have been proposed in recent years.

BRIEF SUMMARY OF THE INVENTION

It is possible, by mounting a microcomputer in a discharge lamp lighting device, to control the lighting sequence and electric power of a high-pressure discharge lamp very accurately and to control various anti-error protecting functions. Consequently, an added value of the discharge lamp lighting device can be enhanced. However, since microcomputer processing typically progresses in accordance with the programs previously recorded on a ROM, various actions of the discharge lamp are controlled in accordance with ROM-recorded sets of setup data. To modify these settings, the contents of the ROM need to be updated. Although a flash ROM can be easily updated in contents, modifying a mask ROM in contents requires creating its new version and is thus a time-consuming and expensive task. In addition, even a flash ROM does not permit its internal setup data to be modified during the operation of the discharge lamp lighting device.

To solve the above problems, the present invention makes various sets of setup data modifiable by assigning an external communication function to a microcomputer designed to control a discharge lamp.

In the present invention, a UART (Universal Asynchronous Receiver Transmitter) can be used for communication between the microcomputer of a discharge lamp lighting device and an external device and hence to perform operations such as setting the internal inverter frequency of the discharge lamp lighting device and setting the permission/prohibition of external synchronization.

The present invention is effective in that it can provide a discharge lamp lighting device enhanced in added value.

DETAILED DESCRIPTION OF THE INVENTION

Embodiments of the present invention are described below using the accompanying drawings.

First Embodiment

Figure 1:
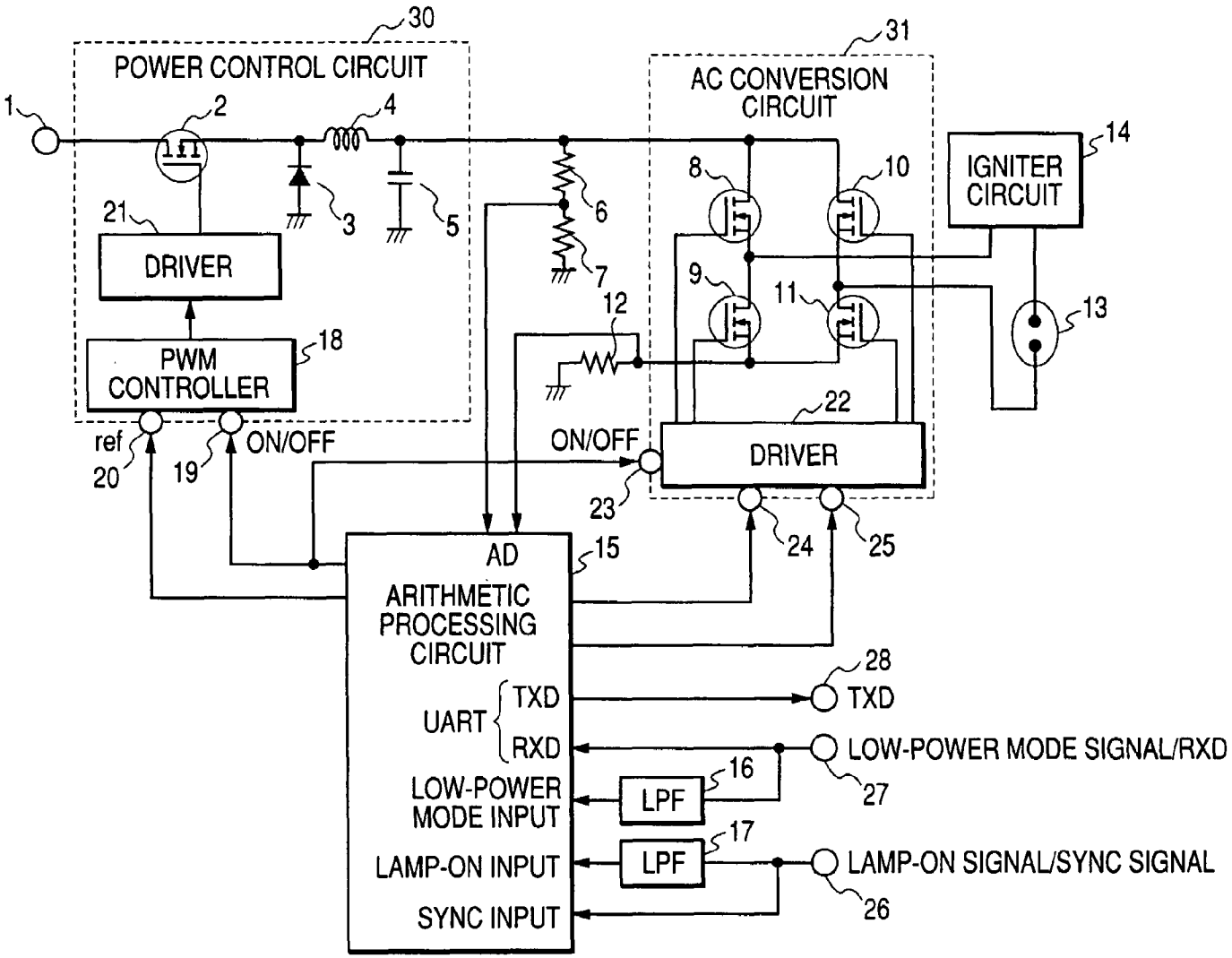
FIG. 1 is a block diagram showing a first embodiment of a discharge lamp lighting device which applies the present invention.

FIG. 1 is a block diagram showing a first embodiment of a discharge lamp lighting device which applies the present invention.

Figure 2:
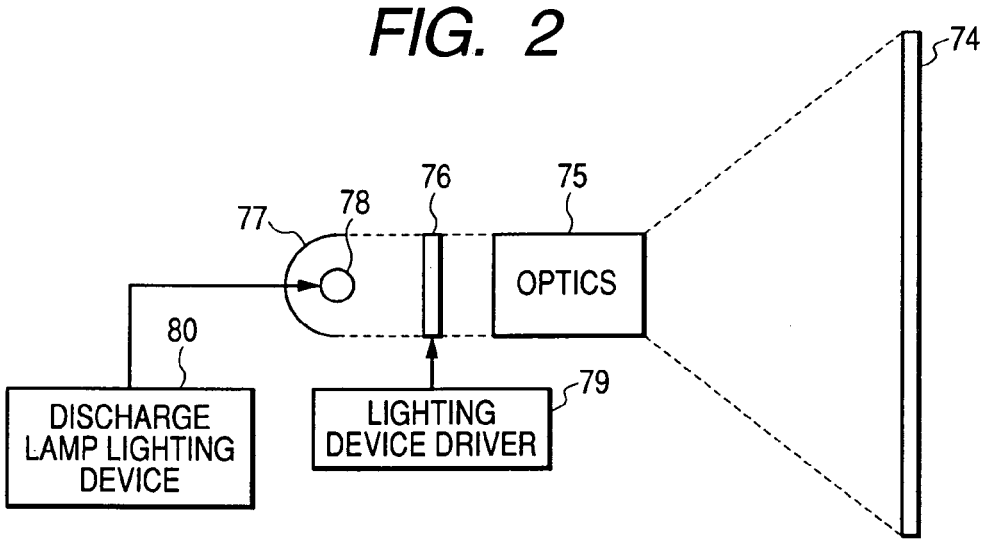
FIG. 2 is a block diagram of a projector applying a discharge lamp lighting device according to the present invention.

The discharge lamp lighting device is applied to, for example, a projection-type display shown in FIG. 2. Referring to FIG. 2, a reflector 77 and a high-pressure discharge lamp 78 constitute a light source that irradiates light from the rear of an image display device 76. The light, after being passed through the image display device 76, is projected onto a screen 74 through optics 75. The image display device 76 is, for example, a liquid-crystal display element, and is driven by an image display device driver 79 and thus displays an image, whereby a large-screen image can be obtained on the screen 74. A discharge lamp lighting device 80 controls starting up and lighting up the high-pressure discharge lamp 78.

Referring back to FIG. 1, symbol 1 denotes a power supply input terminal; 2, an MOS-FET; 3, a diode; 4, a choke coil; 5, a capacitor; 6, 7, resistors; 8, 9, 10, 11, MOS-FETs; 12, a resistor; 13, a discharge lamp; 14, an igniter circuit; 15, an arithmetic processing circuit; 16, 17, low-pass filters (LPFs); 18, a PWM controller; 19, an ON/OFF signal input terminal of the PWM controller 18; 20, a control voltage input terminal of the PWM controller 18; 21, a driver of the MOS-FET 2; 22, a driver of the MOS-FETs 8, 9, 10, 11; 23, an ON/OFF signal input terminal of the driver 22; 24, 25, input terminals of the driver 22; 26, a lamp-on signal input terminal; 27, a low-power mode signal input/serial data receiving terminal (hereinafter, referred to as RXD); and 28, a serial data transmitting terminal (hereinafter, referred to as TXD).

The MOS-FET 2, the diode 3, the choke coil 4, the capacitor 5, the driver 21, and the PWM controller 18 constitute a power control circuit 30. The MOS-FETs 8, 9, 10, 11, and the driver 22 constitute an alternating-current (AC) conversion circuit 31. The igniter circuit 14 generates high-voltage pulses and starts the high-pressure discharge lamp 13.

The arithmetic processing circuit 15 is constructed of, for example, a microcomputer. The arithmetic processing circuit 15 includes a bi-directional communication unit which conducts bi-directional communications with an exterior of the discharge lamp lighting device 80, and is adapted to control the discharge lamp lighting device 80 in accordance with a required command received via the bi-directional communication unit. One embodiment of a bi-directional communication unit is a unit using UART communication. The circuit 15 detects an output voltage from a voltage divided in the resistors 6, 7, and further detects an output current from a voltage generated in the resistor 12. In accordance with detection results on the above-mentioned output voltage and output current, the arithmetic processing circuit 15 also computes the output voltage and then controls this voltage by applying a limiting voltage to the control voltage input terminal 20 of the PWM controller 18 to ensure a constant output voltage. Additionally, the arithmetic processing circuit 15 compares the above-described detection results with limit values LV1 and LV2 determined inside the processing circuit 15. Here, LV1 signifies an output voltage limit value and LV2 signifies an output current limit value. If the above-detected output voltage is in excess of LV1, a signal is transmitted to both the ON/OFF signal input terminal 19 of the PWM controller 18 and the ON/OFF signal input terminal 23 of the driver 22 to stop the discharge lamp lighting device. If the above-detected output current is in excess of LV2, a control voltage is applied to the control voltage input terminal 20 of the PWM controller 18 so that the output current will be limited by a current value determined by LV2. In both cases, the PWM controller 18 is thus controlled.

Next, the basic operation of a typical discharge lamp lighting device is described below.

Figure 3:
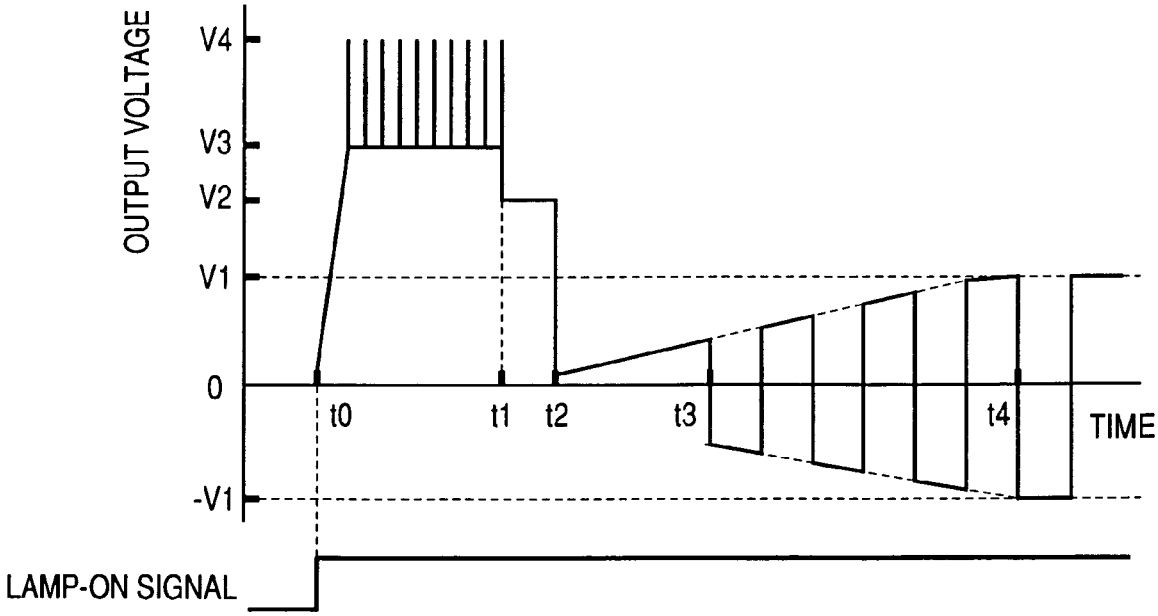
FIG. 3 is a diagram explaining how an output voltage changes from the lighting start of a discharge lamp to stable lighting thereof in the first embodiment of the discharge lamp lighting device applying the present invention.

First, the way the high-pressure discharge lamp 13 is started up is described referring to FIG. 3. FIG. 3 is a timing chart explaining how an output voltage changes from the time the discharge lamp lighting device receives an input from the lamp-on input terminal 26, to the time the discharge lamp enters a stable lighting state. In FIG. 3, "Lamp-on signal" denotes a change in a lamp-on signal received from the lamp-on input terminal 26.

At a time "t0", when the lamp-on signal is received and enters an active Hi (high) state (see FIG. 3), a maximum voltage V3 is output as an output voltage of the power control circuit 30 since the lamp 13 is not on. When a high-voltage pulse from the igniter circuit 14 is further superimposed on the above-mentioned voltage V3, a voltage V4 is applied to the high-pressure discharge lamp 13, thus starting up the lamp. Next, at a time "t1", high-voltage small-current glow discharge is started, and this state further changes to high-voltage small-current arc discharge at a time "t2". The lamp voltage increases with increases in a temperature of the lamp. At a time "t3", the AC conversion circuit 31 starts operating and the high-pressure discharge lamp 13 changes to an AC lighting mode. After this, when a stationary voltage V4 is reached at a time "t4", the power control circuit 30 supplies constant electric power to the high-pressure discharge lamp 13 by activating constant-power control. The frequency of a rectangular wave from "t3" onward is generally called the inverter frequency.

Operation modes of the discharge lamp after it has been lit up (i.e., after "t4" in FIG. 3) are described next. There are typically four operation modes of the discharge lamp: (1) an "off" mode in which the lamp is off, (2) a stationary power mode in which the lamp is normally on, (3) a low-power mode in which the lamp is lit up with power suppressed below that of the stationary power mode, and (4) an extremely-low-power mode in which, when the stationary power mode or the low-power mode is changed to the "off" mode, the lamp is lit up with the power reduced to, for example, about 30% of its original level and this state is maintained.

In the low-power mode, effects such as noise reduction can be obtained since it is possible, by lighting up the lamp with the power suppressed to, for example, about 80% of the power level used in the stationary power mode, to suppress power consumption and thus extend lamp life and to reduce a rotating speed of a lamp fan.

It is understood that in the extremely-low-power mode, when the lamp changes from its "on" state to an "off" state, power is temporarily maintained at a very low level, not immediately changed to a power level of 0, for reduced electrode deterioration and hence for longer lamp life.

Figure 4:
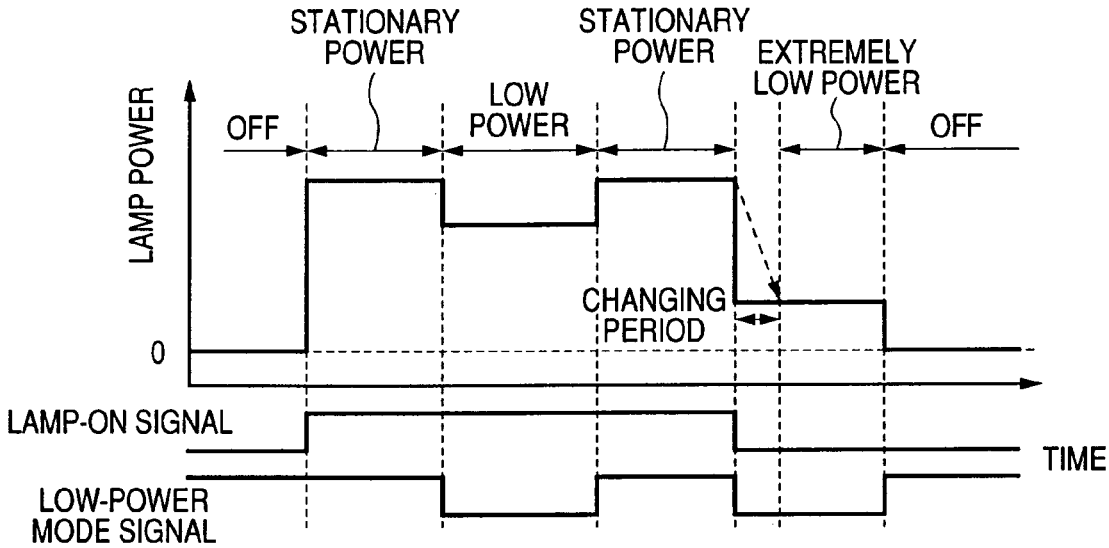
FIG. 4 is a timing chart explaining the operation of the present invention.

A timing chart of the above operation modes is shown in FIG. 4. In FIG. 4, operation starts from the "off" mode, and then changes to the stationary power mode on lighting, and after temporarily changing to the low-power mode, returns to the stationary power mode. Finally, the operation mode changes to the "off" mode.

The four modes of the lamp are each identified by a combination of two bits, one for a lamp-on signal entering the input terminal 26 of the arithmetic processing circuit 15, and the other for a low-power mode signal entering the input terminal 27. (Hereinafter, for the sake of convenience in description, these signals are referred to as the signals 26, 27.) More specifically, as listed in FIG. 4, when the combination of the lamp-on signal 26 and the low-power mode signal 27 is (Low, Hi), this denotes the "off" mode. Likewise, (Hi, Hi) denotes the stationary power mode, (Hi, Low) the low-power mode, and (Low, Low) the extremely-low-power mode.

When operation changes from the stationary power mode or the low-power mode to the extremely-low-power mode, the power level momentarily changes, for example, from 100% (or 80%) to 30%, and this change is likely to cause electrode deterioration.

Therefore, as indicated by the dotted-line arrow in the lamp power level transition diagram of FIG. 4, a change period of about several seconds may be provided for power to be reduced gently when operation changes from the stationary power mode or the low-power mode to the extremely-low-power mode. A further life-extending effect can be obtained as a result. Hereinafter, the mode during such a change period is referred to as a slow extremely-low-power mode.

The basic operation of the discharge lamp lighting device has been described heretofore.

Figure 5:
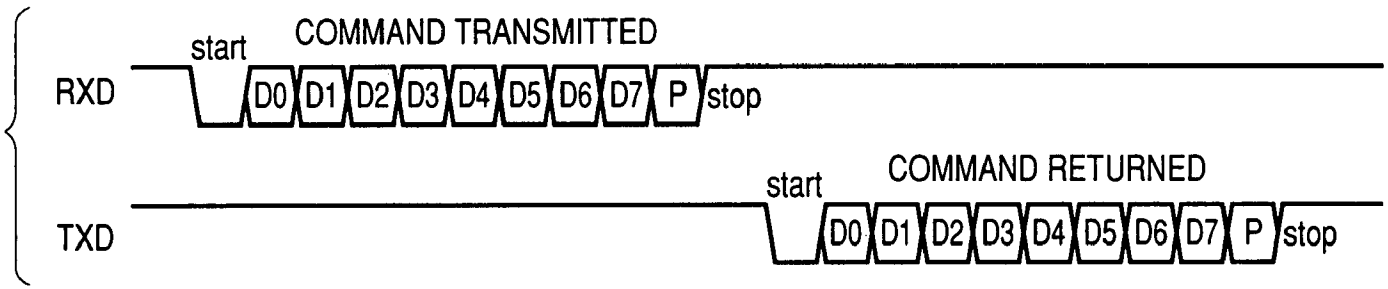
FIG. 5 is a diagram explaining the UART communication conducted according to the present invention.

Next, description is given of the UART communication control featuring the present embodiment. UART communication is full-duplex communication during which data can be transmitted and received simultaneously. It is an asynchronous communication scheme in which data is transmitted with a start bit and a stop bit appended to the front and rear, respectively, of the data. The RS-232C communication using a personal computer is a typical example. FIG. 5 shows an example of a UART communication command format, in which RXD denotes command data sending and TXD denotes command data receiving. In both cases, one command is constituted of 1 start bit, 1 stop bit, 8 data bits, and 1 parity bit. The RXD and TXD here are equivalent to the low-power mode signal RXD 27 and TXD 28 shown in FIG. 1.

The use of RXD requires care since it is also used as a low-power mode signal. For UART communication, when a command is not yet transmitted, both RXD and TXD need to be at a "Hi" level as in FIG. 5. Therefore, although UART communication is possible in the stationary power mode and "off" mode where the low-power mode signal RXD 27 becomes "Hi", the UART communication is not possible in the low-power mode and extremely-low-power mode where the low-power mode signal RXD 27 becomes "Low".

Next, such control functions as listed in Table 1 below are assigned to different types of command data. Commands 30H to 33H, where H stands for hexadecimal notation, set the inverter frequency to predefined values. The command 30H, for example, activates the arithmetic processing circuit 15 to control the AC conversion circuit 31 so that the inverter frequency is 150 Hz. Since the inverter frequency can be arbitrarily changed in this manner, a life-extending effect can be obtained by, for example, optimizing the inverter frequency according to a particular usage time of the lamp.

TABLE 1

| | Command | Name | Description of control |
|---|---|---|---|
| 1 | 30H | Inverter frequency 1 | Sets the inverter frequency to 150 HZ. |
| 2 | 31H | Inverter frequency 2 | Sets the inverter frequency to 170 HZ. |
| 3 | 32H | Inverter frequency 3 | Sets the inverter frequency to 190 HZ. |
| 4 | 33H | Inverter frequency 4 | Sets the inverter frequency to 210 HZ. |
| 5 | 34H | Slow extremely-low-power ON | Permits the use of slow extremely-low-power transition mode. |
| 6 | 35H | Slow extremely-low-power OFF | Prohibits the use of slow extremely-low-power transition mode. |
| 7 | 36H | External synchronization ON | Permits external synchronization. |
| 8 | 37H | External synchronization OFF | Prohibits external synchronization. |

For a command 34H, the arithmetic processing circuit 15 controls power so that before operation changes to the extremely-low-power mode mentioned above, the operation enters a slow extremely-low-power transition mode.

Figure 6:
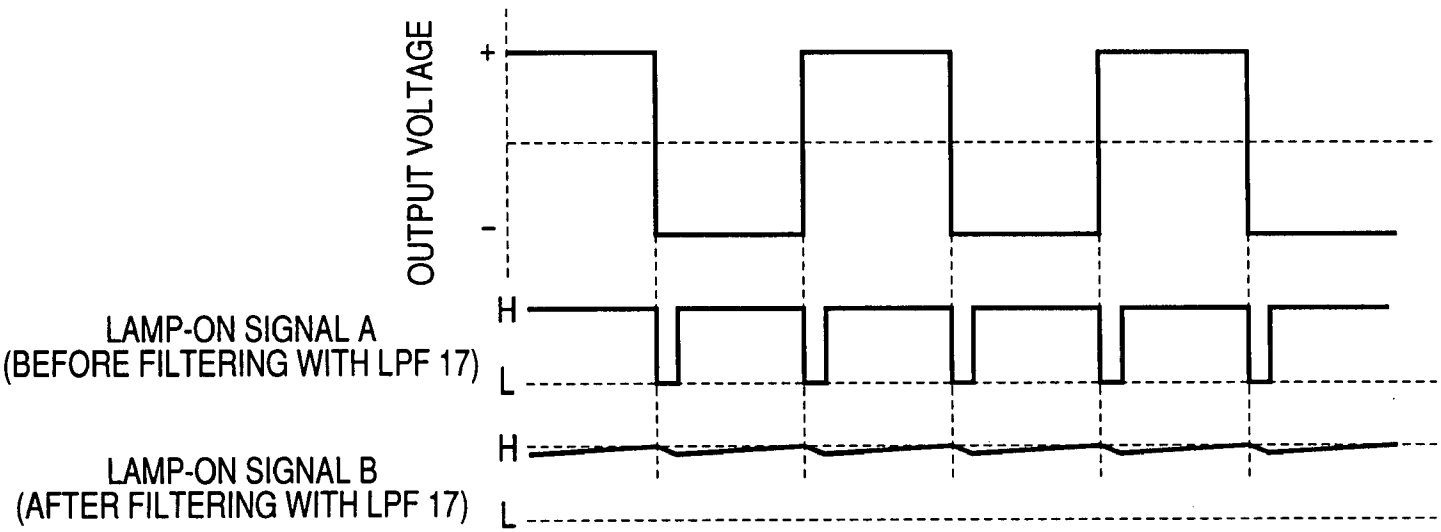
FIG. 6 is a timing chart explaining the external synchronizing operation of the present invention.

Next, the ON/OFF operation of external synchronization using commands 36H and 37 H is described. External synchronization means causing the inverter frequency and power superimposition to be synchronized with respect to a trigger signal received from an exterior of the discharge lamp lighting device. FIG. 6 shows how the external synchronization is established. In general, the external trigger signal is superimposed on the lamp-on signal and input to the discharge lamp lighting device. When the lamp is on (i.e., in the stationary power mode or low-power mode of FIG. 4), the lamp-on signal is "Hi", and when the synchronization is established, the lamp changes to "Low" (i.e., a lamp-on signal A in FIG. 6 is generated). The arithmetic processing circuit 15 controls the AC conversion circuit 31 so that an AC driving function operates at the falling edge of the lamp-on signal A.

However, malfunction results if the lamp-on signal A in FIG. 6 is used intact to identify the operation mode. More specifically, during a superimposing period of the external trigger, the lamp-on signal is maintained at a "Low" level and the "off" mode persists as the operation mode. To avoid the inconvenience, the LPF 17 is inserted on a route of the lamp-on signal and the results obtained by filtering with the LPF are integrated, whereby a signal of a substantially "Hi" level, such as a lamp-on signal B of FIG. 6, can be obtained. Thus, malfunction can be avoided by using this lamp-on signal B for mode identification.

The same also applies to the low-power mode signal RXD 27. Using the low-power mode signal RXD 27 intact for mode identification causes malfunction since, when a command is transmitted, there exists a period during which the signal becomes "Low". To avoid this, the LPF 16 is inserted on a route of the low-power mode signal RXD 27 and the results obtained by filtering with the LPF are integrated.

As described above, according to the present embodiment, inverter frequency setting, slow extremely-low-power control, external synchronization control, and the like can be performed by conducting UART communication control of the discharge lamp lighting device.

Second Embodiment

Figure 7:
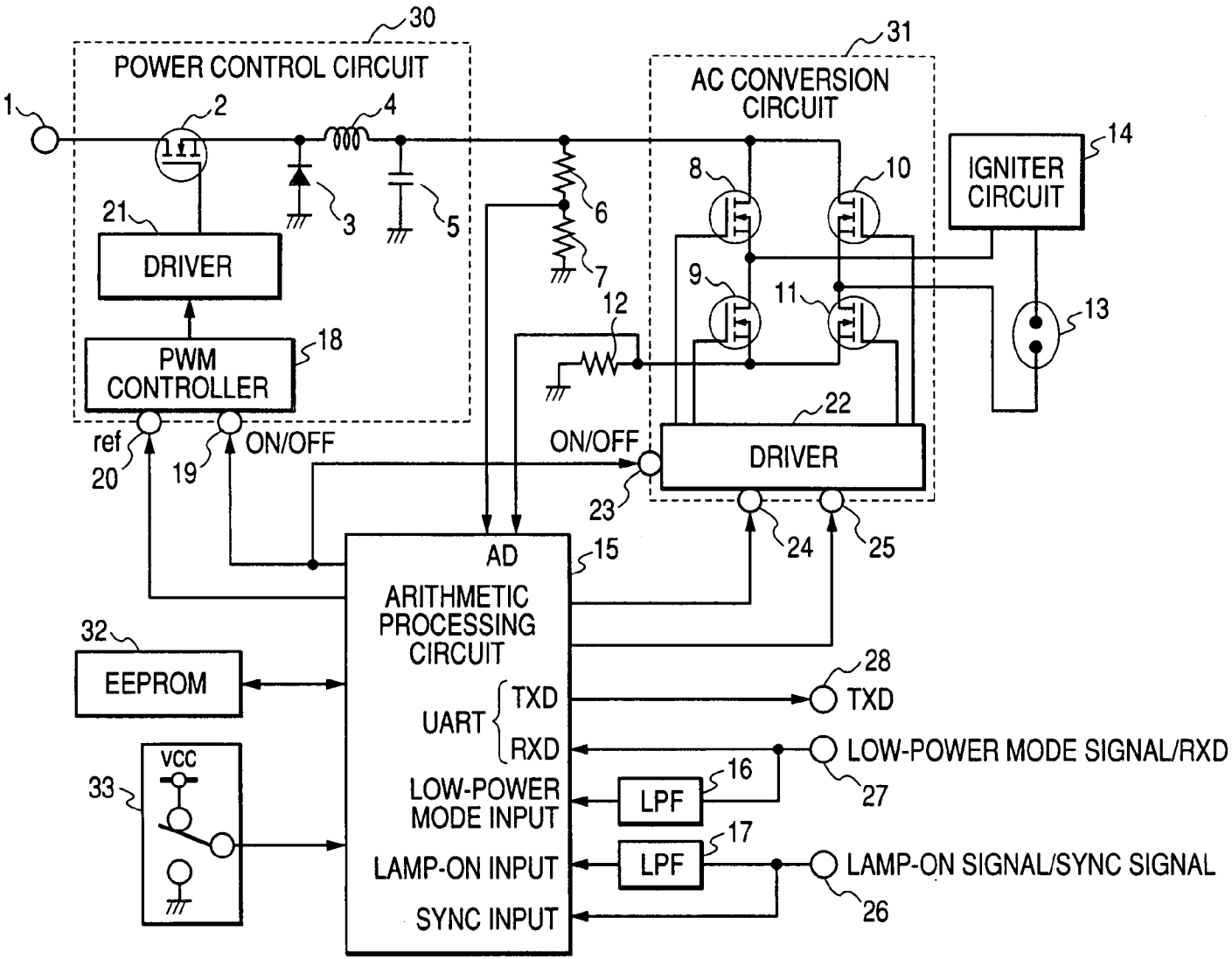
FIG. 7 is a block diagram showing a second embodiment of a discharge lamp lighting device which applies the present invention.

Next, an example of circuit composition according to a second embodiment of the present invention is shown in FIG. 7. The present embodiment is characterized in that multiple lamps can be lit up with one discharge lamp lighting device by providing an involatile memory such as an EEPROM, storing multiple sets of setup data in the memory, and modifying desired sets of setup data according to a difference in the types of lamps to be connected. Additionally, it is possible to accommodate sudden changes in design and to improve development efficiency, by making the internal setup data of the EEPROM modifiable.

In FIG. 7 that shows the circuit composition according to the second embodiment of the present invention, the same symbol is assigned to each of sections equivalent to those of FIG. 1 which shows an example of the circuit composition according to the first embodiment. The composition in FIG. 7 differs in that an EEPROM 32 and a DIP switch 33 that allows "Hi"/"Low" output selection are provided. Description of all other sections is omitted since each is the same as in the first embodiment.

Figure 8:
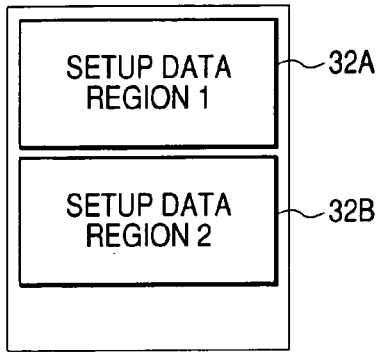
FIG. 8 is a diagram explaining a memory map of an EEPROM used in the second embodiment.

The EEPROM 32 is connected to an arithmetic processing circuit 15 by a three-wire serial bus or the like, and is capable of reading out and writing in data. Further, various sets of setup data likely to require modification according to lamp types or during a development and design phase are saved in a split form in multiple internal regions of the EEPROM 32. FIG. 8 shows one such example, in which two types of setup data regions, 32A and 32B, are provided. For example, when a lamp manufactured by company A is to be used as a lamp 13, data is read in from the setup data region 32A, and when a lamp manufactured by company B is to be used, data is read in from the setup data region 32B. The DIP switch 33 is used to select either of the setup data regions. When an output of the DIP switch 33 is "Hi", data is read in from setup data region 32A, and when the output of the DIP switch 33 is "Low", data is read in from setup data region 32B. If three or more setup data regions are to be set, the number of bits in the output of the DIP switch 33 can be increased according to the number of setup data regions desired.

Next, a specific example of setup data is shown in Table 2 below. The setup data in Table 2 is a specific example of data settings in one setup data region. The settings are: (1) a load current limit value, (2) a slow extremely-low-power duration, (3) an inverter frequency, (4) an extremely-low-power level value, (5) an overvoltage limit value, (6) a low-voltage limit value, (7) an overpower limit value, (8) a temperature limit value, (9) an input voltage limit value, (10) a pulse-superimposing height ratio, and (11) a pulse-superimposing width. Details of these settings are as shown in Table 2, and further detailed description of the settings is omitted.

TABLE 2

| No. | Name | Description of the value | Set value |
|---|---|---|---|
| 1 | Load current limit value | Maximum current value when lamp is ON | 4 A |
| 2 | Slow extremely-low-power duration | Time required for a change to slow extremely-low-power mode | 1 sec |
| 3 | Inverter frequency | AC operating frequency of AC conversion circuit 31 | 178 Hz |
| 4 | Extremely-low-power level value | Power value in extremely-low-power mode | 60 W |
| 5 | Overvoltage limit value | Maximum output voltage value of power control circuit 30 | 150 V |
| 6 | Low-voltage limit value | Minimum output voltage value of power control circuit 30 | 10 V |
| 7 | Overpower limit value | Maximum power value of power control circuit 30 | 200 W |
| 8 | Temperature limit value | Maximum operating temperature of the discharge lamp lighting device | 117° C. |
| 9 | Input voltage limit value | Maximum input voltage value of power control circuit 30 | 300 V |
| 10 | Pulse-superimposing height ratio | Superimposing ratio of power = (amount of pulse superimposition + stationary value)/stationary value | 136% |
| 11 | Pulse-superimposing width | Pulse-superimposing period of power | 778 μsec |

In the present embodiment, setup data within the EEPROM can be read/written from an exterior of the discharge lamp lighting device via UART communication. Table 3 below an exemplifies UART commands associated with EEPROM data reading/writing. FIGS. 9 to 12 each show an example of a UART communication protocol

TABLE 3

| | Command | Name | Description of control |
|---|---|---|---|
| 1 | 50H | 1-byte write | Writes 1-byte data into EEPROM. |
| 2 | 51H | Multiple-byte write | Writes multiple-byte data into EEPROM. |
| 3 | B0H | 1-byte read | Reads 1-byte data from EEPROM. |
| 4 | B1H | Multiple-byte read | Reads multiple-byte data from EEPROM. |

Figure 9:
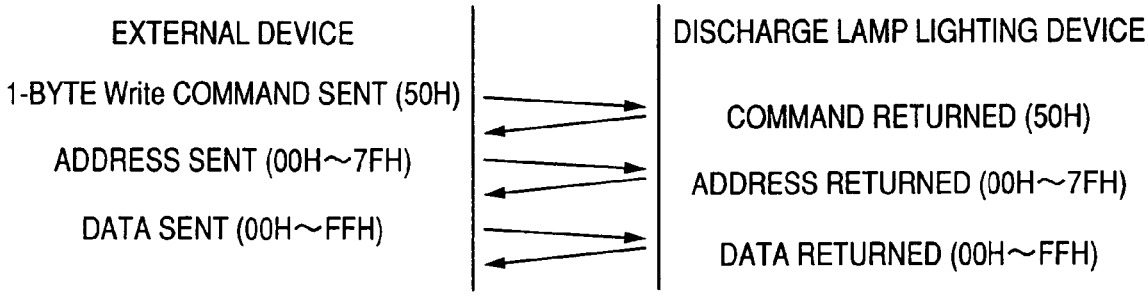
FIG. 9 is a diagram that explains 1-byte writing during UART communication in the second embodiment.

FIG. 9 shows an example of a protocol for 1-byte data writing into the EEPROM. First, a command 50H is transmitted from an external device to the discharge lamp lighting device. The arithmetic processing circuit 15 of the discharge lamp lighting device receives the command and returns the same command 50H to the external device. Next, the arithmetic processing circuit 15 receives an address and data, and similarly to the above, returns the same address and the same data. After this, the arithmetic processing circuit 15 writes the data into a specified address of the EEPROM 32, thus completing the operation.

Figure 10:
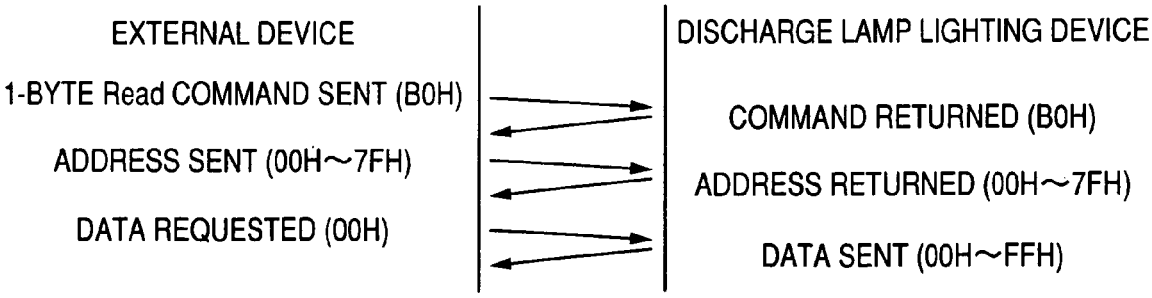
FIG. 10 is a diagram that explains 1-byte reading during UART communication in the second embodiment.

FIG. 10 shows an example of a protocol for 1-byte data reading from the EEPROM. First, a command B0H is transmitted from the external device to the discharge lamp lighting device. The arithmetic processing circuit 15 of the discharge lamp lighting device receives the command and returns the same command B0H to the external device. Next, the arithmetic processing circuit 15 receives an address and similarly to the above, returns the same address. After this, the arithmetic processing circuit 15 reads data from a specified address of the EEPROM 32 and stores the data. Finally, the arithmetic processing circuit 15 receives a data request command 00H and returns the stored data.

Figure 11:
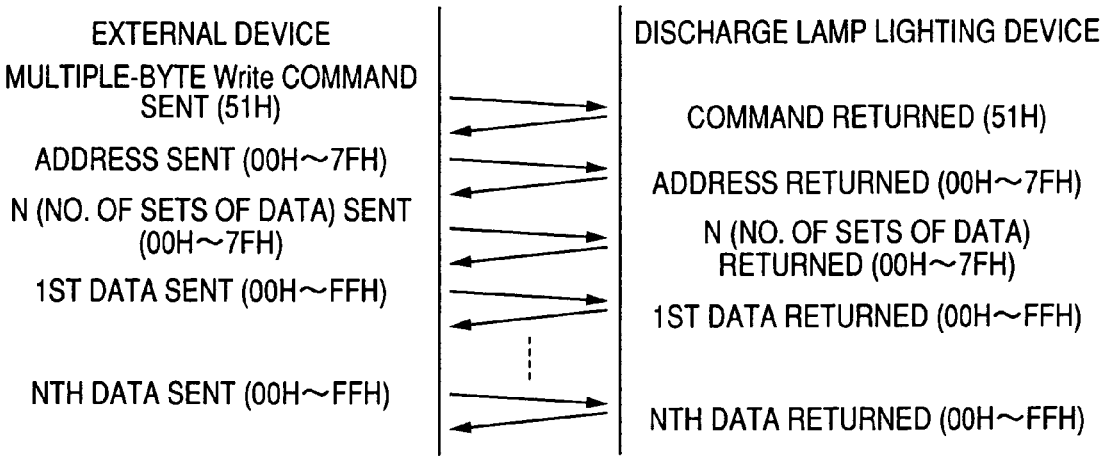
FIG. 11 is a diagram that explains multiple-byte writing during UART communication in the second embodiment.
Figure 12:
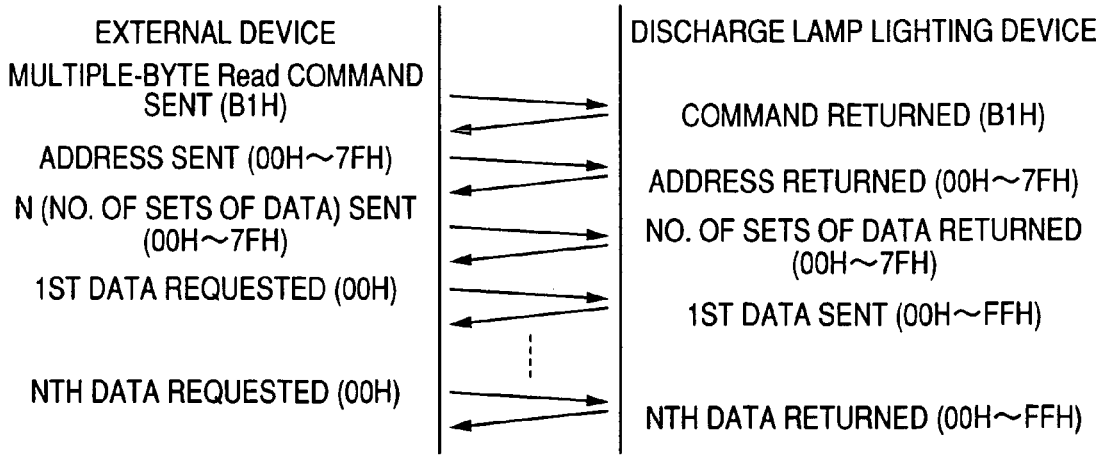
FIG. 12 is a diagram that explains multiple-byte reading during UART communication in the second embodiment.

FIGS. 11 and 12 show examples of protocols for respectively writing and reading multiple bytes of data. The operation in these figures is substantially the same as that of FIGS. 9 and 10, except that a command specifying the number of sets of data to be read/written is transmitted after an address has been transmitted and received. Data as much as there actually are bytes in the above command is transmitted and received. The transmitted address is a starting address of the data. The address is incremented by 1 with each additional set of data.

The DIP switch 33 may be a slide switch or a rotary switch or may be merely set by means of resistor wiring.

Third Embodiment

Figure 13:
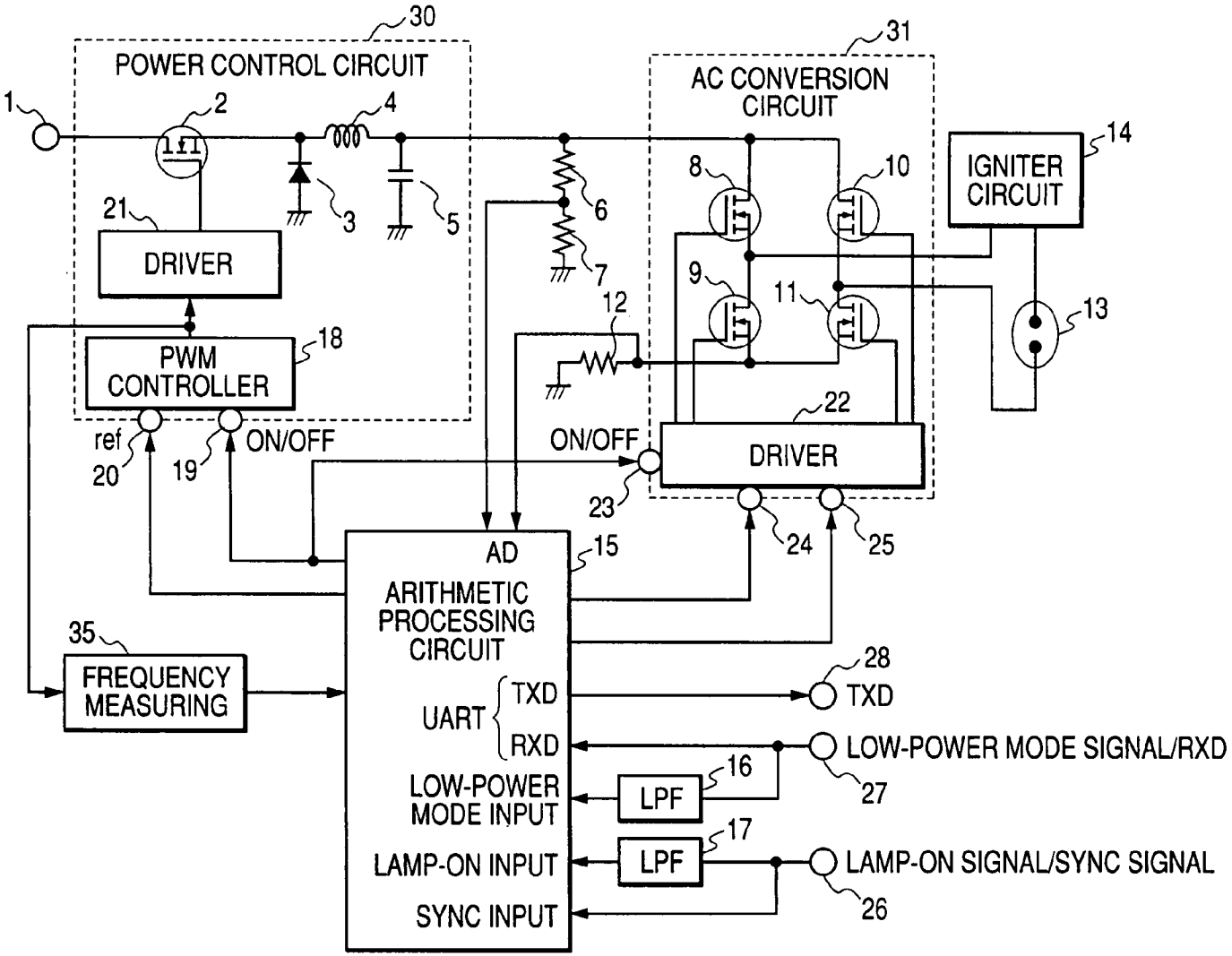
FIG. 13 is a block diagram showing a third embodiment of a discharge lamp lighting device which applies the present invention.

Next, an example of circuit composition according to the third embodiment of the present invention is shown in FIG. 13. The present embodiment is characterized in that an operating state of a discharge lamp lighting device can be inquired about via UART communication.

In FIG. 13 that shows the circuit composition according to the third embodiment of the present invention, the same symbol is assigned to each of sections equivalent to those of FIG. 1 which shows an example of the circuit composition according to the first embodiment. The composition in FIG. 13 differs in that a frequency-measuring circuit 35 is provided. Description of all other sections is omitted since each is the same as in the first embodiment.

Table 4 below exemplifies a command associated with inquiry from an external device. For example, when a command A0H is transmitted from the external device to the discharge lamp lighting device, an arithmetic processing circuit 15 returns an inverter frequency currently being used. When a command A1H is transmitted, the frequency-measuring circuit 35 measures an output, so-called chopper frequency, of a PWM controller 18 provided in a power control circuit 30, and the arithmetic processing circuit 15 receives frequency measurement results and returns the results to the external device. The frequency-measuring circuit 35 is constructed of, for example, a counter circuit, and when the number of pulses during a period of one second is counted, this count denotes the frequency. When a command 82H is transmitted, the arithmetic processing circuit 15 returns a present state of the discharge lamp lighting device. If an error is not occurring, a command 00H is returned. If an error is occurring, a command associated with the error is returned. For example, even after an "off" mode has been set as an operation mode, if the power control circuit 30 generates an output voltage, a command 0EH is returned since a lamp voltage error is judged to have occurred. When the operation mode is a stationary power mode or a low-power mode, if lamp power exceeding a limit value is supplied, a command 0FH is returned since a lamp overpower is judged to have occurred.

TABLE 4

| | Command sent | Name | Command returned | Description of the command returned |
|---|---|---|---|---|
| 1 | A0H | Inverter frequency | 00H-FFH | Inverter frequency value is returned. |
| 2 | A1H | Chopper frequency | 00H-FFH | Chopper frequency value is returned. |
| 3 | 82H | State inquiry | 00H | No error |
| | | | 0EH | Lamp OFF or lamp voltage error |
| | | | 0FH | Lamp overpower |

The above inquiry command is only an example, and the command may be extended when any other state of the discharge lamp lighting device is to be examined.

While the second and third embodiments have heretofore been described assuming the use of the EEPROM 32 as an involatile memory, the present invention is not limited by these embodiments and a flash ROM or the like may be used instead. Further, although the UART scheme has been used for communication, three-wire serial communication or other communication schemes may be used instead.

As described above, the discharge lamp lighting device of the present invention can be improved in added value by, during operation, modifying various data settings, and confirming states of the discharge lamp lighting device, by means of UART communication control.

In addition, multiple lamps can be lit up with one discharge lamp lighting device by providing an involatile memory such as an EEPROM, saving multiple sets of setup data in the memory, and modifying desired sets of setup data according to a difference in the types of lamps to be connected.

What is claimed is:

1. A discharge lamp lighting device, comprising:

a power control circuit which controls a power to drive a discharge lamp;

a voltage detector which detects an output voltage of the power control circuit;

a current detector which detects a current supplied to the discharge lamp;

a bi-directional communication unit which communicates an exterior of the discharge lamp lighting device via a bi-directional communication; and a processing circuit which controls the power control circuit in accordance with a detection result of the voltage detector, a detection result of the current detector and a required command received by the bi-directional communication, wherein the processing circuit changes a driving status of the power control circuit from a stationary driving state driven in a normal power to a low power driving state over 0.5 seconds, the low power driving state in which the power being lower than a power in the stationary driving state and through which the driving status of the power control circuit moves from the stationary driving state to a turn-off state.

2. The discharge lamp lighting device according to claim 1, wherein the processing circuit includes the bi-directional communication unit.

3. The discharge lamp lighting device according to claim 1, wherein the power control circuit controls the power at a power level of 50% or less of a stationary driving state in the low power driving state.

* * * * *

UNITED STATES PATENT AND TRADEMARK OFFICE

CERTIFICATE OF CORRECTION

PATENT NO. : 7,541,748 B2
APPLICATION NO. : 11/248785
DATED : June 2, 2009
INVENTOR(S) : Haruna et al.

It is certified that error appears in the above-identified patent and that said Letters Patent is hereby corrected as shown below:

Title Page:
At (10) Patent No.

"7,541,748 B2"

should read,

--7,541,748 B2*--

In the bibliographic data at (*) Notice,

"Subject to any disclaimer, the term of this patent is extended or adjusted under 35 U.S.C. 154(b) by 424 days."

should read,

--Subject to any disclaimer, the term of this patent is extended or adjusted under 35 U.S.C. 154(b) by 424 days.

This patent is subject to a terminal disclaimer.--

Signed and Sealed this

Twenty-seventh Day of April, 2010

David J. Kappos

David J. Kappos
*Director of the United States Patent and Trademark Office*